US010744504B2

(12) United States Patent
Huang et al.

(10) Patent No.: US 10,744,504 B2
(45) Date of Patent: Aug. 18, 2020

(54) MICROSCALE SAMPLING DEVICE

(71) Applicant: DELTA ELECTRONICS, INC., Taoyuan (TW)

(72) Inventors: Song-Bin Huang, Taoyuan (TW); Wei-Yu Chung, Taoyuan (TW); Shing-Lun Liu, Taoyuan (TW); Qian Liang, Taoyuan (TW); Yu-Kai Kao, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 345 days.

(21) Appl. No.: 15/857,919

(22) Filed: Dec. 29, 2017

(65) Prior Publication Data

US 2019/0201896 A1 Jul. 4, 2019

(51) Int. Cl.

| | |
|---|---|
| ***B01L 99/00*** | (2010.01) |
| ***B01L 3/00*** | (2006.01) |
| ***B01L 3/02*** | (2006.01) |

(52) U.S. Cl.

CPC ..... *B01L 3/502746* (2013.01); *B01L 3/0293* (2013.01); *B01L 3/50273* (2013.01); *B01L 2200/0605* (2013.01); *B01L 2300/0809* (2013.01); *B01L 2400/049* (2013.01); *B01L 2400/0457* (2013.01); *B01L 2400/084* (2013.01)

(58) Field of Classification Search

None

See application file for complete search history.

(56) References Cited

U.S. PATENT DOCUMENTS

| | | | | |
|---|---|---|---|---|
| 2004/0116686 | A1* | 6/2004 | Akashi | B01L 3/50273 536/25.4 |
| 2008/0190220 | A1 | 8/2008 | Backes et al. | |
| 2008/0213755 | A1 | 9/2008 | Geiser et al. | |
| 2011/0003286 | A1 | 1/2011 | Hanafusa et al. | |

FOREIGN PATENT DOCUMENTS

| | | | |
|---|---|---|---|
| WO | 03089565 | A | 10/2003 |

OTHER PUBLICATIONS

European Search Report issued in corresponding European Patent Application No. 18214696.9, dated Feb. 27, 2019, pp. 1-11, European Patent Office, Munich, Germany.

* cited by examiner

*Primary Examiner* — Paul S Hyun
(74) *Attorney, Agent, or Firm* — Hauptman Ham, LLP

(57) ABSTRACT

A microscale sampling device including a frame is provided in the present invention, a sample container, a communicating channel and a resistance channel are defined in the frame. At least one sampling chamber is defined in the communicating channel. An end of the communicating channel is communicated with the sample container and the communicating channel is arranged below the sample container. An end of the resistance channel is communicated with the sampling chamber, and the other end of the resistance channel is communicated to an output joint. The resistance channel is shaped with at least one discontinuous shape change.

13 Claims, 14 Drawing Sheets

MICROSCALE SAMPLING DEVICE

TECHNICAL FIELD

The present invention relates to a sampling device, and in particular to a microscale sampling device.

BACKGROUND

A conventional automatic biological testing equipment is used for taking a specific quantity of target sample from a specific sample reservoir and transferring to another reaction chamber. This sampling process is one of the most important processes of the whole biochemical reactions. Usually, a conventional large equipment performs the aforementioned sampling process by a three-axis robot with a pipettor. However, the large equipment cannot be used on POCT (Point of Care Testing) because of its size, and its sampling chamber and transferring route for the sample are open. Therefore, the sample might be contaminated, and the test results might perform pseudo-positive or pseudo-negative.

A conventional micro channel sampling device is used for accurately sampling a specific quantity of sample for dispensing, and is divided to two types: electrical control type and physical control type. The electric control sampling device is suitable for detecting a sample containing polarizable liquid or particles, the sample is polarized to produce electrophoretic or dielectrophoretic forces, and a specific quantity of sample thereby could be taken accurately. The electric control sampling device is usually applied to electrophoresis analysis of DNA or RNA. However, the sample should withstand serious electric field change and should be polarizable, and the electric control sampling device is therefore only applied to specific types of sample. Furthermore, components of the sample for the electrical control programs process should be accurately controlled. However, component proportion of clinical samples are difficult to be accurately controlled and therefore unsuitable for the electric control sampling device.

The physical control sampling device is able to accurately take a specific quantity of sample by mechanical structure (pipe) and physical control (gas driving or mechanical driving). The physical control sampling devices are commonly used sampling devices. However, the physical control sampling device only operates single sampling and dispensing process at the same time and therefore unsuitable for group sampling.

In views of this, in order to solve the above disadvantage, the present inventor studied related technology and provided a reasonable and effective solution in the present invention.

SUMMARY

The present invention relates to a self-driving microscale sampling device.

A microscale sampling device including a frame is provided in the present invention, a sample container, a communicating channel and a resistance channel are defined in the frame.

At least one sampling chamber is defined in the communicating channel. An end of the communicating channel is communicated with the sample container and the communicating channel is arranged below the sample container. An end of the resistance channel is communicated with the sampling chamber, and the other end of the resistance channel is communicated to an output joint. The resistance channel is shaped with at least one discontinuous shape change.

According to the microscale sampling device of the present invention, at least one discontinuous depth change, and the resistance channel is shaped with a discontinuous width change or a discontinuous corner. The resistance channel is arranged above the communicating channel.

According to the microscale sampling device of the present invention, the other end of the communicating channel is communicated with a recycling chamber, the recycling chamber is communicated with a negative pressure source or outside environment. the sample container contains a liquid sample below a predetermined level, an inlet communicated with the communicating channel is defined on the recycling chamber, and the inlet is arranged above the predetermined level.

According to the microscale sampling device of the present invention, the output joint is inserted in a tube, the tube is communicated to a negative pressure source or outside environment.

According to the microscale sampling device of the present invention, a bypass channel is formed in the output joint. The output joint is inserted in a tube, the tube could be communicated to outside environment via the bypass channel, and the communicating channel is communicated to a positive pressure source. A docking plate is embedded with the frame, a docking channel is defined in the docking plate, and the docking channels is communicated between outside environment and the bypass channel.

The output joint is inserted in a tube, and the tube alternatively could be communicated to a negative pressure source via the bypass channel. A docking plate is embedded with the frame, a docking channel is defined in the docking plate, and the docking channels is communicated between the negative pressure source and the bypass channel.

The docking plate cover and close the resistance channel.

According to the microscale sampling device of the present invention, multiple sampling chambers arranged along the communicating channel are defined in the communicating channel, and a plurality of resistance channels communicated with the respective sampling chambers are defined on the frame, each resistance channel communicated with the corresponding sampling chamber is not longer than another resistance channel communicated with another sampling chamber closer to the sample container.

According to the microscale sampling device of the present invention, the liquid sample in the sample container could be driven to flow into the respective sampling chambers by the gravity thereof caused by a height shift between the sample container and the sampling chamber. Furthermore, the gravity of the liquid sample could be balanced by the resistances caused by the respective resistance channels communicated with the respective sampling chambers, and the demanded quantities of the liquid samples thereby could be reserved accurately in the respective sampling chamber. Therefore, an additional pressure source for driving the liquid sample in the sample container to flow into the sampling chamber is not necessary according to the microscale sampling device of the present invention.

BRIEF DESCRIPTION OF DRAWING

The present invention can be more fully understood by reading the following detailed description of the embodiment, with reference made to the accompanying drawings as follows.

DETAILED DESCRIPTION

Figure 1:
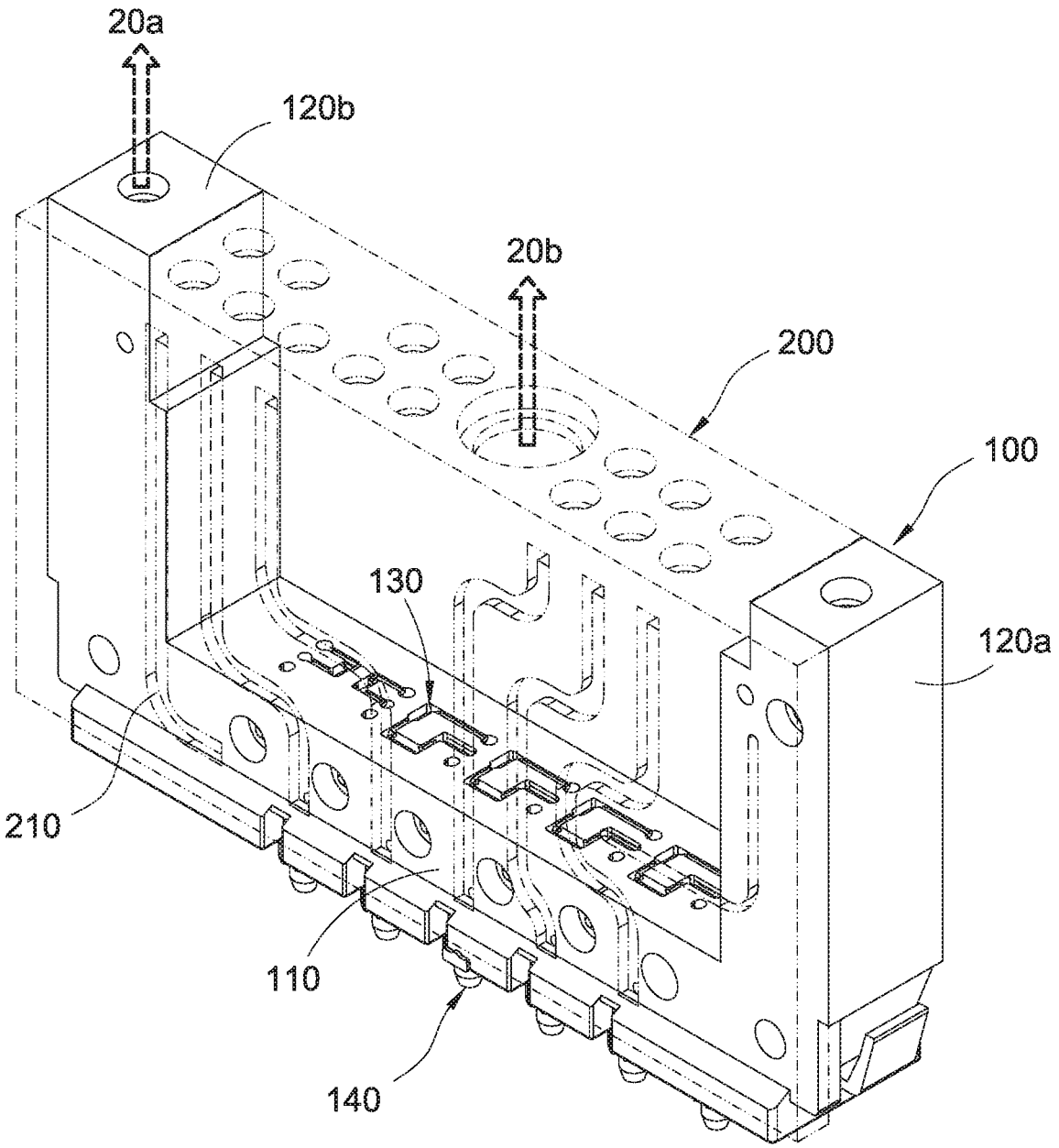
FIG. 1 is a perspective view showing the microscale sampling device of the present invention.
Figure 2:
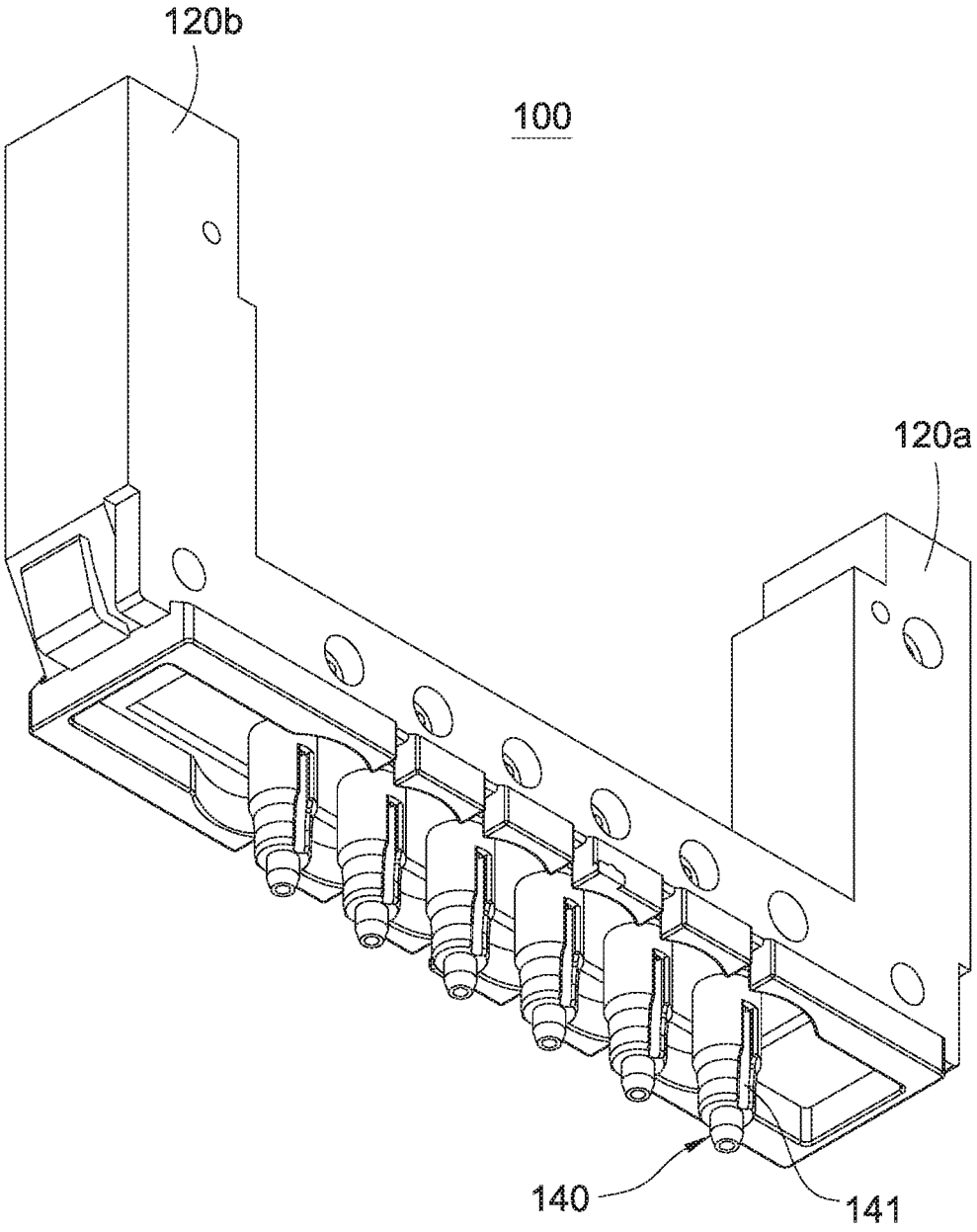
FIG. 2 is a perspective view showing the frame of the microscale sampling device of the present invention.
Figure 3:
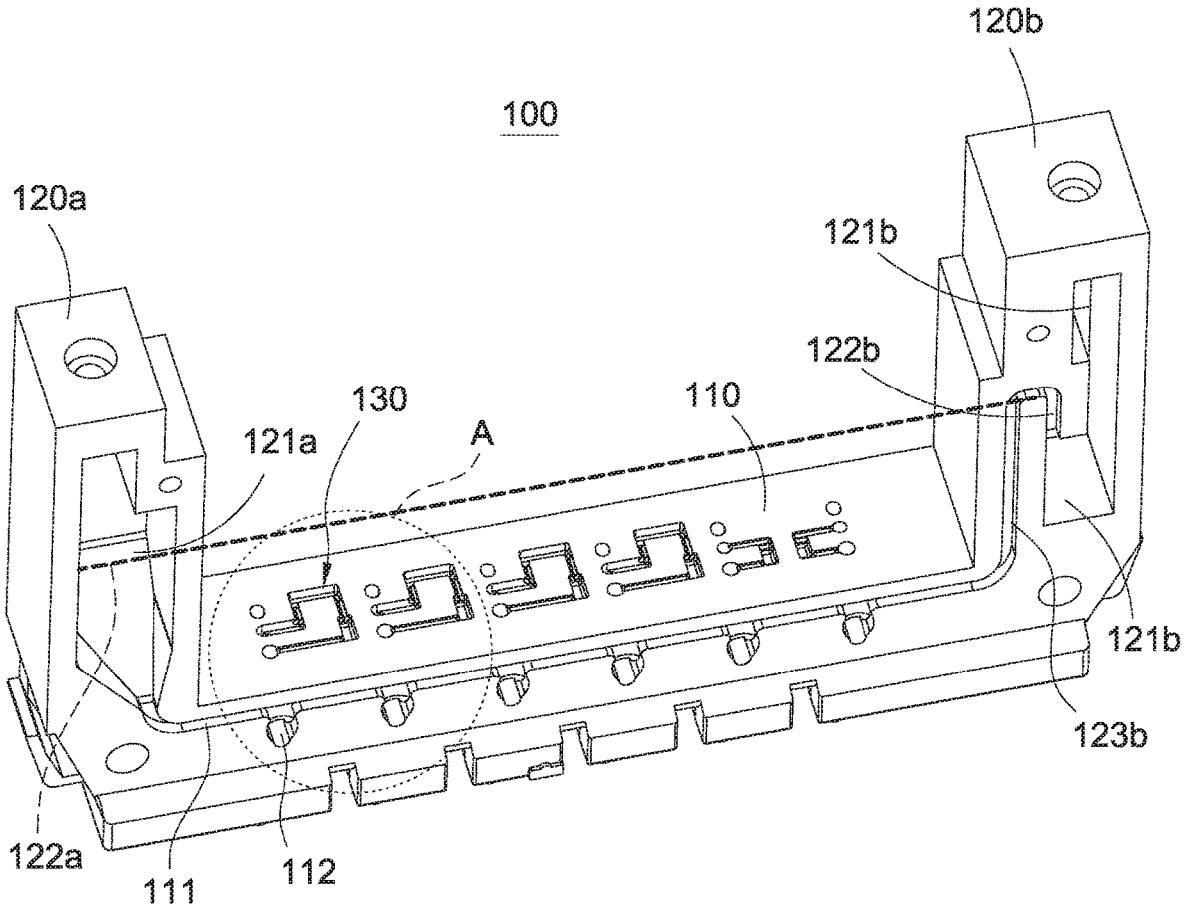
FIG. 3 is another perspective view showing the frame of the microscale sampling device of the present invention.
Figure 4:
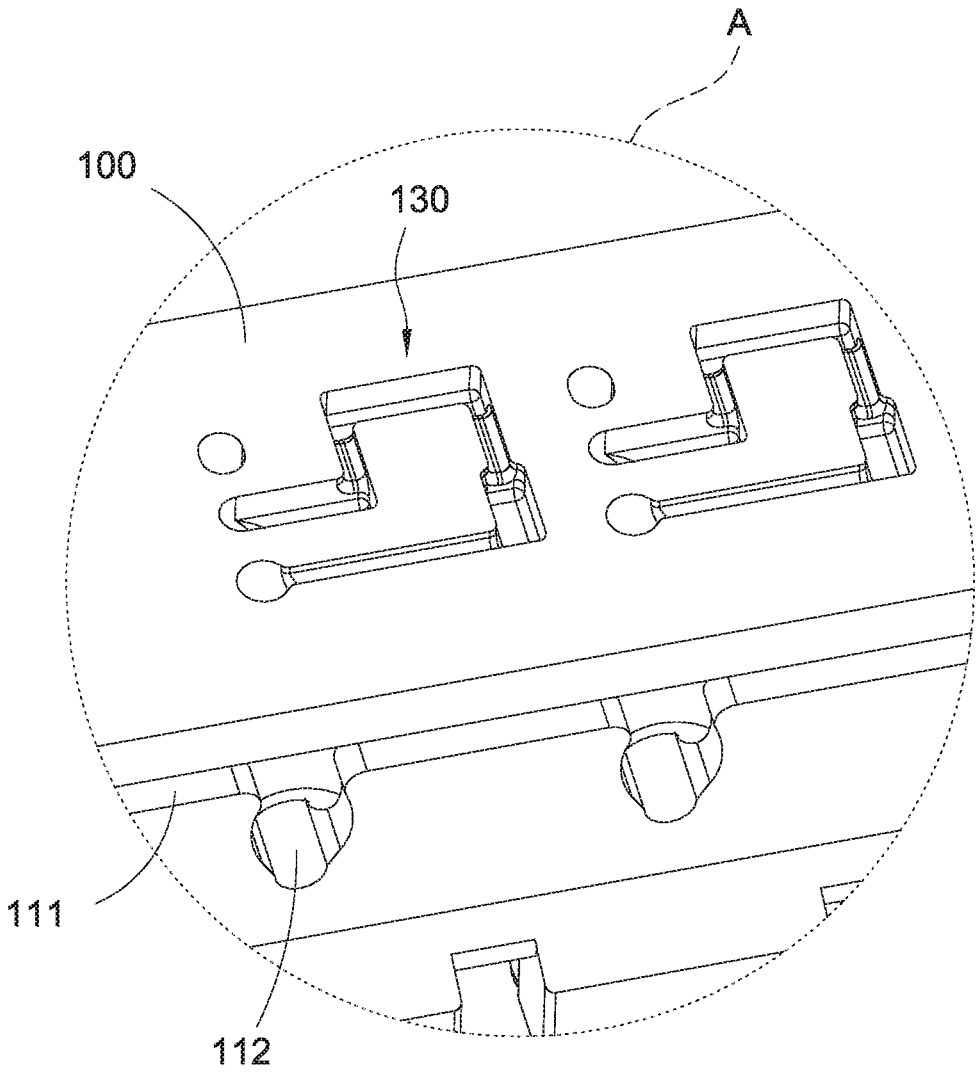
FIG. 4 is an enlarged view showing the area A marked in FIG. 3.
Figure 5:
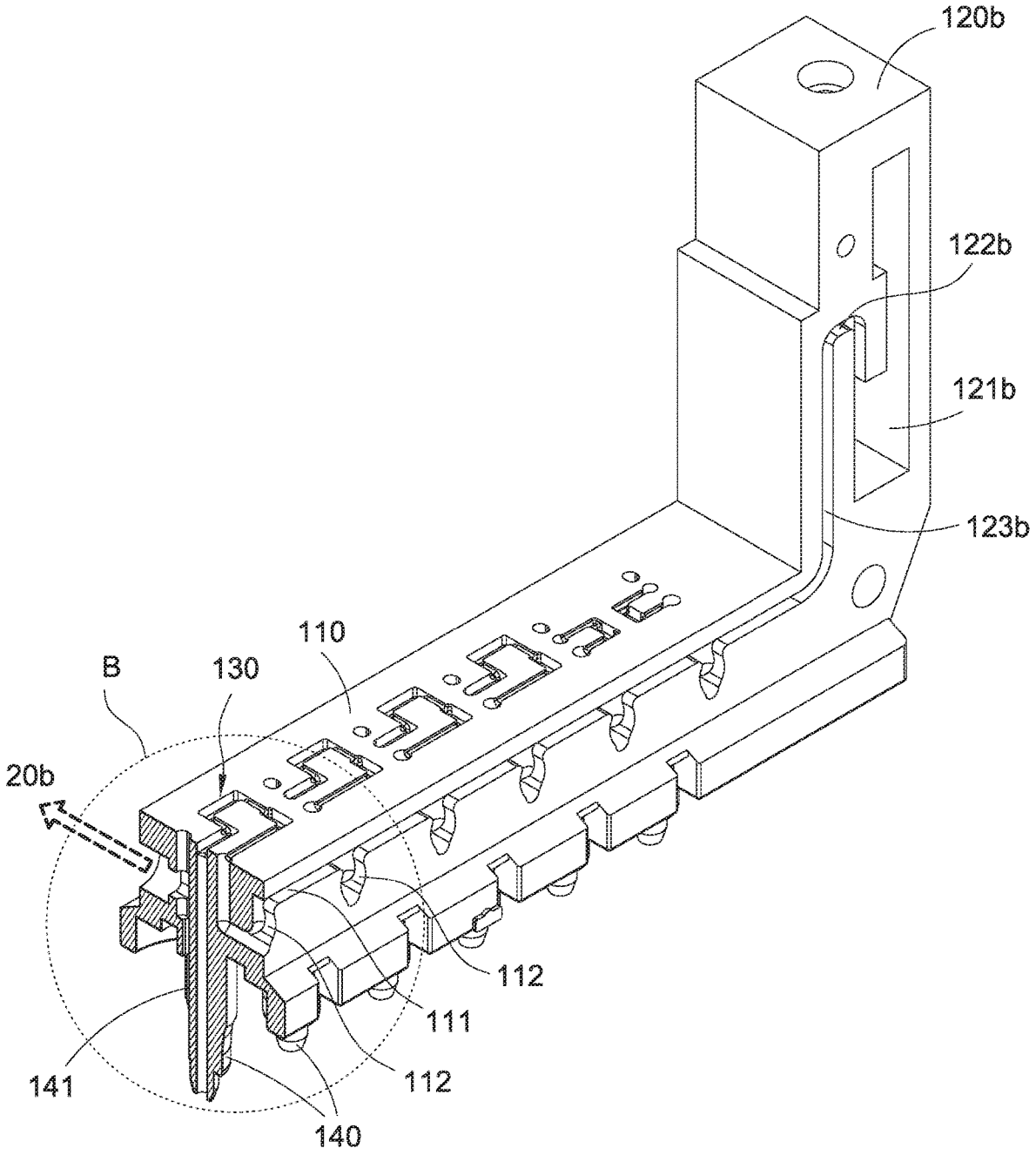
FIG. 5 is a partial sectional view showing the microscale sampling device of the present invention.
Figure 6:
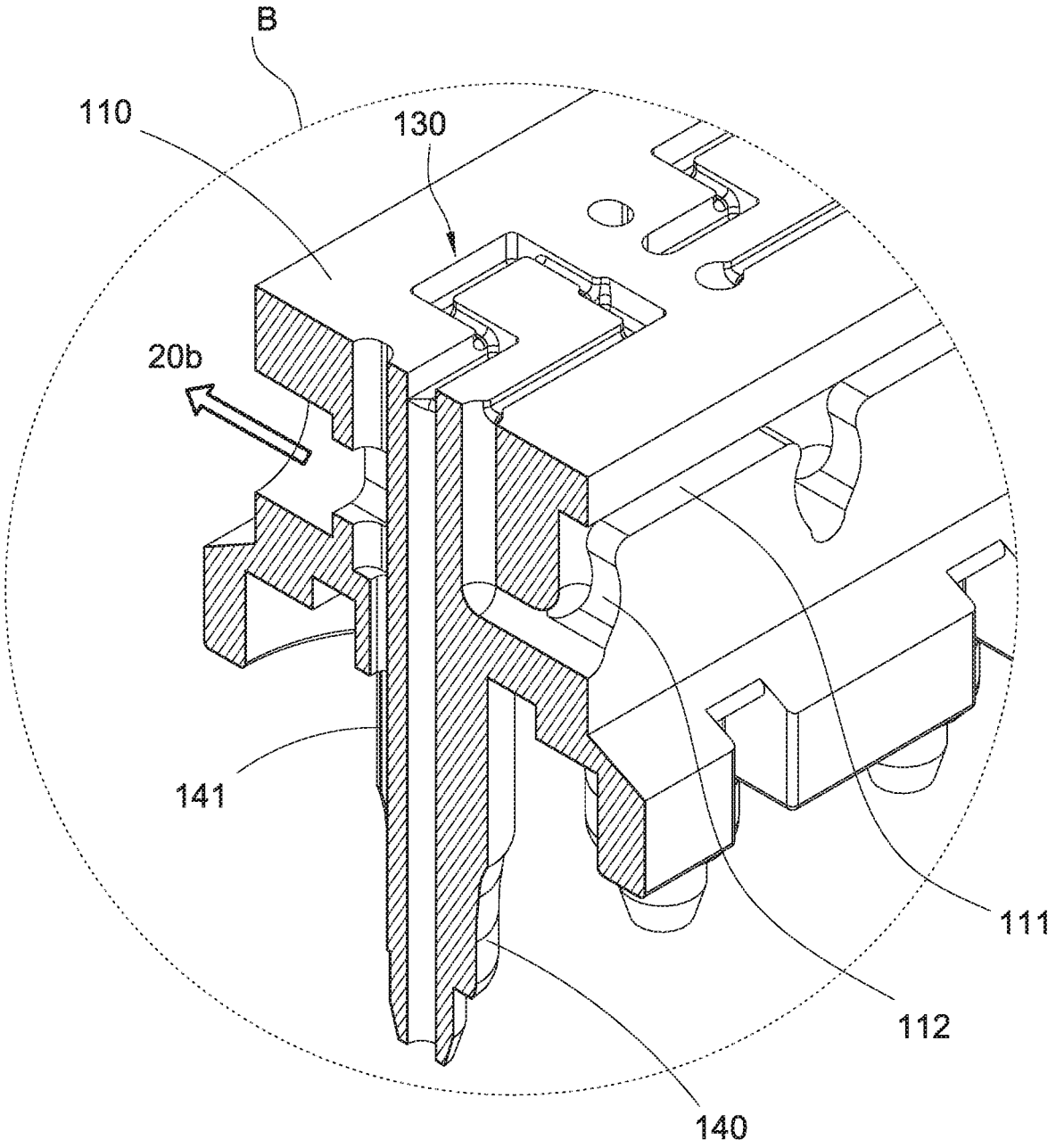
FIG. 6 is an enlarged view showing the area B marked in FIG. 5.

According to FIGS. 1 to 3, a microscale sampling device including a frame 100 and a docking plate 200 is provided in an embodiment of the present invention.

According to the present embodiment shown in FIGS. 4 to 8, the frame 100 preferably includes a horizontal beam 110 arranged horizontally and two columns 120*a*/120*b* upward extended from respective ends of the horizontal beams 110 and thereby upright arranged. A columns 120*a* of the frame 100 is hollow and a sample container 121*a* for containing a liquid sample 10 is thereby defined therein, and a level of the liquid sample 10 contained therein is below a predetermined level 122*a*. The other column 120*b* of the frame 100 is hollow and a recycling chamber 121*b* is thereby defined therein, and the recycling chamber 121*b* could preferably communicated to a negative pressure source 20*a*.

The communicating channel 111 is defined in the horizontal beam 110, and the communicating channel 111 is therefore arranged below the sample container 121*a*. The communicating channel 111 is extended along a longitudinal direction of the horizontal beam 110, an end of the communicating channel 111 is communicated to a bottom of the sample container 121*a*, the communicating channel 111 could extend horizontally or alternatively decline from the sample container 121*a* to the other end of the horizontal beam 110, and the communicating channel 111 other end of the horizontal beam 110 is communicated to a top of the recycling chamber 121*b*. An inlet 122*b* is defined on the top of the recycling chamber 121*b*, and the inlet 122*b* is arranged above the predetermined level 122*a* of the sample container 121*a*, a guiding channel 123*b* is further defined in the column 120*b* where the recycling chamber 121*b* is located, the guiding channel 123*b* is communicated between the communicating channel 111 and the inlet 122*b* of the recycling chamber 121*b*. Thereby, the liquid sample 10 in the sample container 121*a* cannot be driven to flow into the recycling chamber 121*b* by gravity thereof when the negative pressure source 20*a* is invalid.

At least one sampling chamber 112 is formed by a branch extended from the communicating channel 111, according to the present embodiment, multiple sampling chambers 112 having the same basic structure and function are defined in the communicating channel 111, and the sampling chambers 112 are disposed along the communicating channel 111. Furthermore, the sampling chambers 112 are arranged below the communicating channel 111, and the liquid sample 10 contained in the sample container 121*a* can be driven by gravity thereof to flow into and fill the respective sampling chamber 112 through the communicating channel 111. Sizes of the respective sampling chambers 112 are configure according to sampling demands.

At least one resistance channel 130 is defined on the frame 100, multiple concave resistance channels 130 corresponding to the aforementioned respective the sampling chambers 112 are defined on a top of the horizontal beam 110 according to the present invention, the respective resistance channels 130 are separated and isolated from each other. An end of each resistance channel 130 is communicated to the corresponding sampling chamber 112, and the resistance channels 130 are disposed along the communicating channel 111 of the horizontal beam 110 corresponding to the sampling chambers 112. The respective resistance channels 130 are preferably arranged above the communicating channel 111, but scope of the present invention should not be limited to the embodiment. The other end of each resistance channel 130 is communicated to a corresponding output joint 140, according to the present embodiment, the respective output joints 140 are preferable arranged downward protruding on a bottom of the horizontal beam 110. Moreover, each resistance channel 130 communicated with the corresponding sampling chamber 112 is not longer than another resistance channel 130 communicated with another sampling chamber 112 closer to the sample container 121*a*. The gravity of the liquid sample 10 is gradually balanced with flow resistances provided by the communicating channel 111 and the respective resistance channel 130 while flow through the communicating channel 111, shorter resistance channels 130 are accordingly disposed at lower reaches of the communicating channel 111 to provide smaller flow resistances, and the sampling chambers 112 at lower reaches of the communicating channel 111 are therefore ensured to be filled with the liquid sample 10.

Each resistance channel 130 is shaped with at least one discontinuous shape change According to the present embodiment, the aforementioned discontinuous shape change could be a discontinuous depth change, a discontinuous width change or a discontinuous corner, the liquid sample 10 in respective sampling chambers 112 are pressed by a flow resistance caused by the discontinuous shape change of the resistance channel 130 and the gravity caused by the liquid sample 10 contained in the sample container 121*a* is thereby balanced.

Each output joint 140 is inserted in a tube 300, the respective tubes 300 are communicated to a negative pressure source 20*b* for taking out the liquid samples 10 in the respective sampling chambers 112. According to the present embodiment, a bypass channel 141 is defined at an external surface of each output joint 140. The bypass channel 141 could be a close channel or an open channel and is preferably an open channel according to the present embodiment. An internal surface of the tube 300 close the bypass channel 141 to form a close channel when the tube 300 sleeves the output joint 140, and the tube 300 is communicated to the negative pressure source 20*b* via the bypass channel 141.

According to FIGS. 1 to 3, multiple docking channels 210 are defined in the docking plate 200, and the respective docking channels 210 are communicated between a negative pressure source 20*b* and the bypass channel 141. According to the present embodiment, the docking plate 200 is embedded between the two columns 120*a*/120*b* and covers the horizontal beam 110, and the respective resistance channels 130 are covered thereby.

Figure 7:
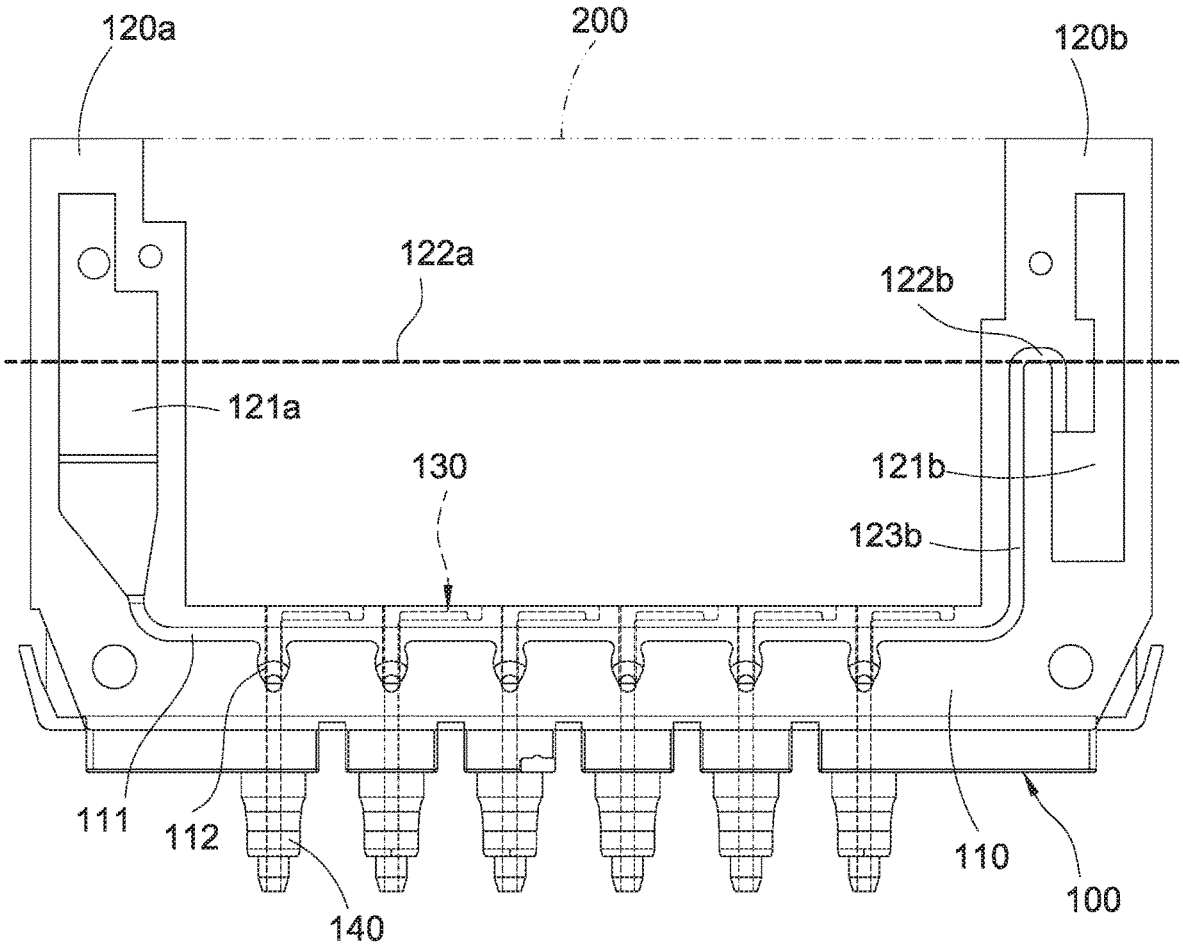
FIG. 7 is a perspective view showing the empty microscale sampling device of the present invention.
Figure 8:
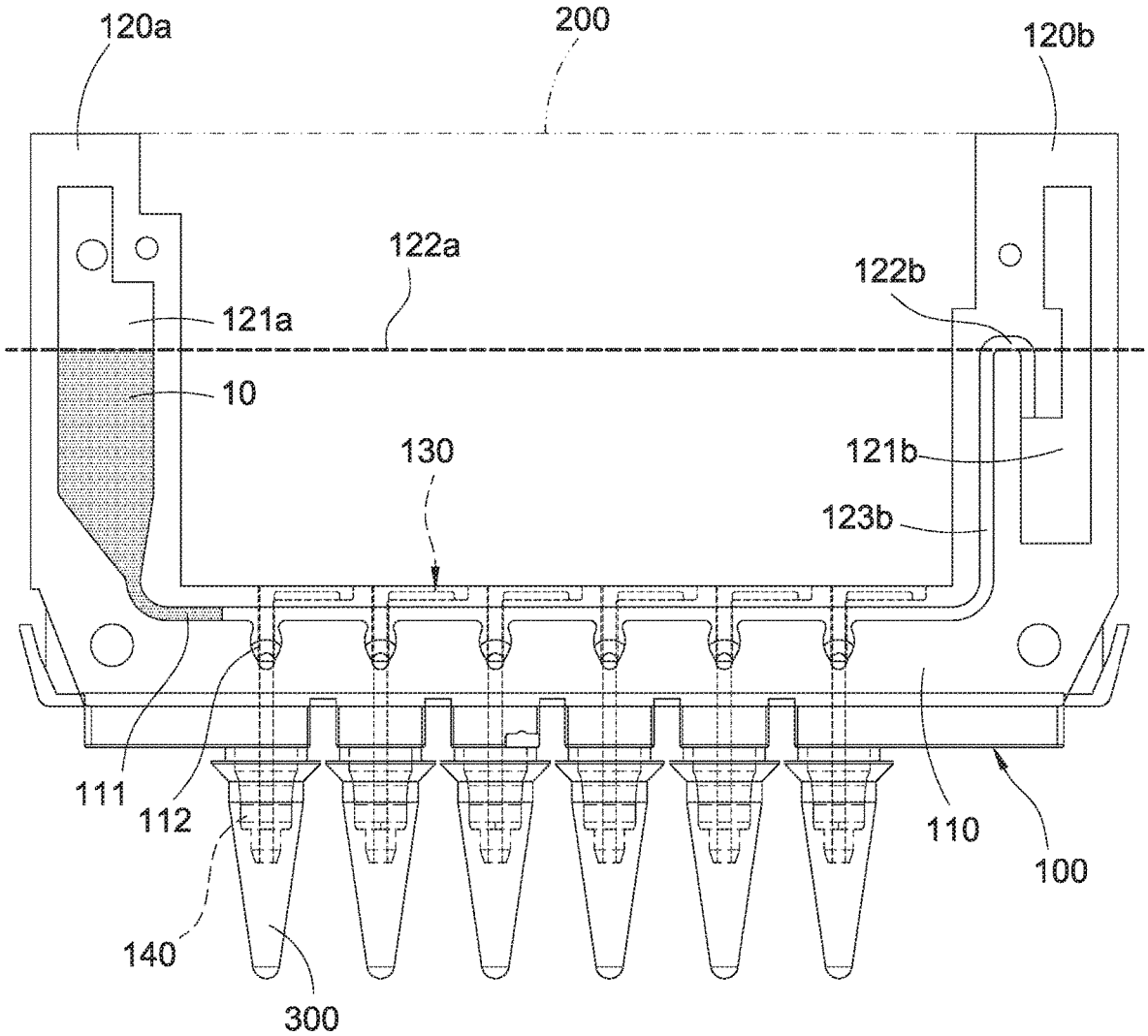
FIG. 8 is a perspective view showing that the liquid sample is injected into the sample container.
Figure 9:
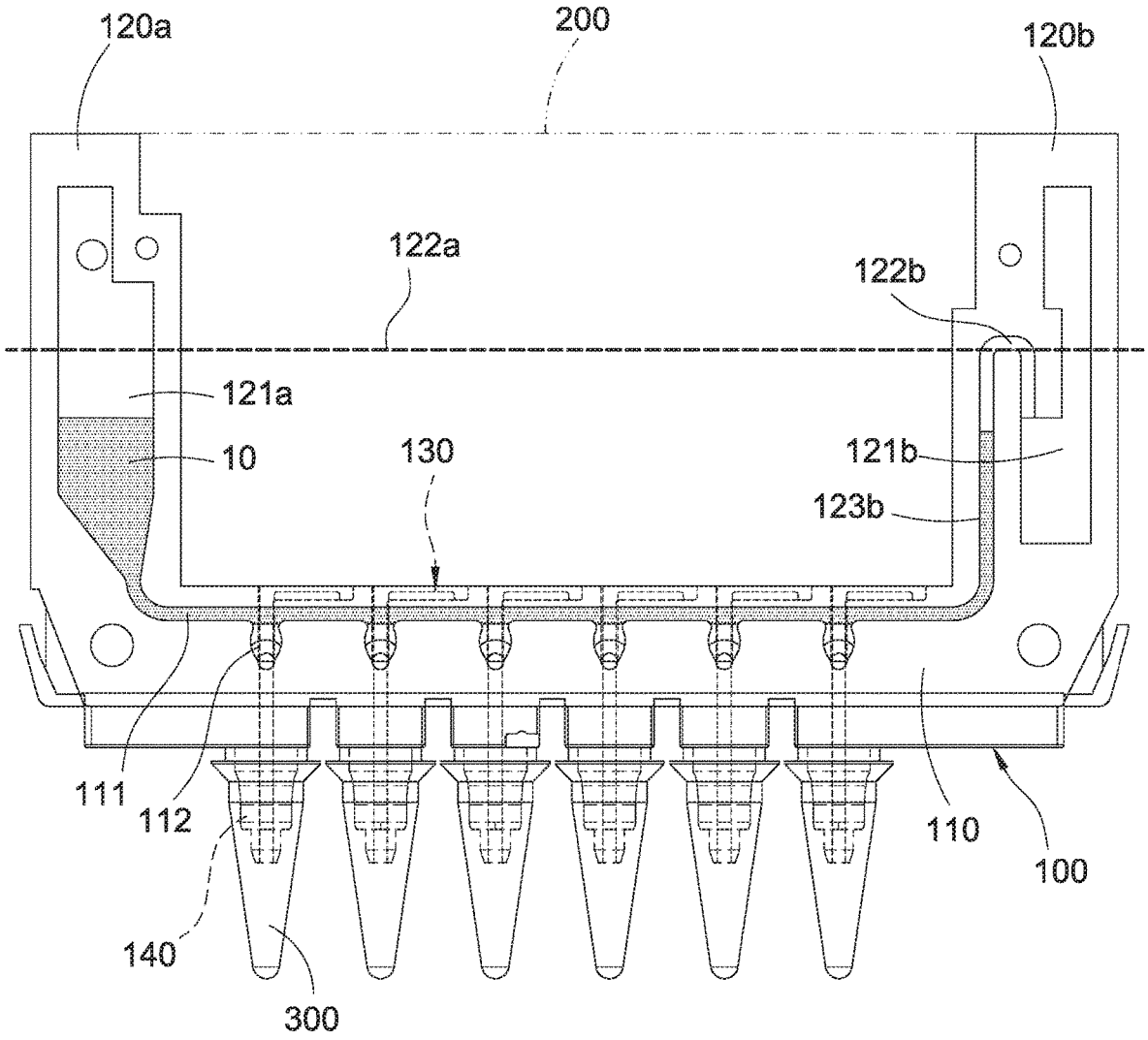
FIG. 9 is a perspective view showing that the liquid sample flows into the communicating channel.

According to FIGS. 7 to 9 showing the operation of the microscale sampling device of the, the liquid sample 10 is firstly inject into the sample container 121*a*, and the level of the liquid sample 10 is below the predetermined level 122*a* of the sample container 121*a*. Then, the liquid sample 10 contained in the sample container 121*a* is driven by the gravity thereof caused by a height shift between the sample container 121*a* and the communicating channel 111 to flow into the communicating channel 111 and flow toward the recycling chamber 121*b* along the communicating channel 111.

Figure 10:
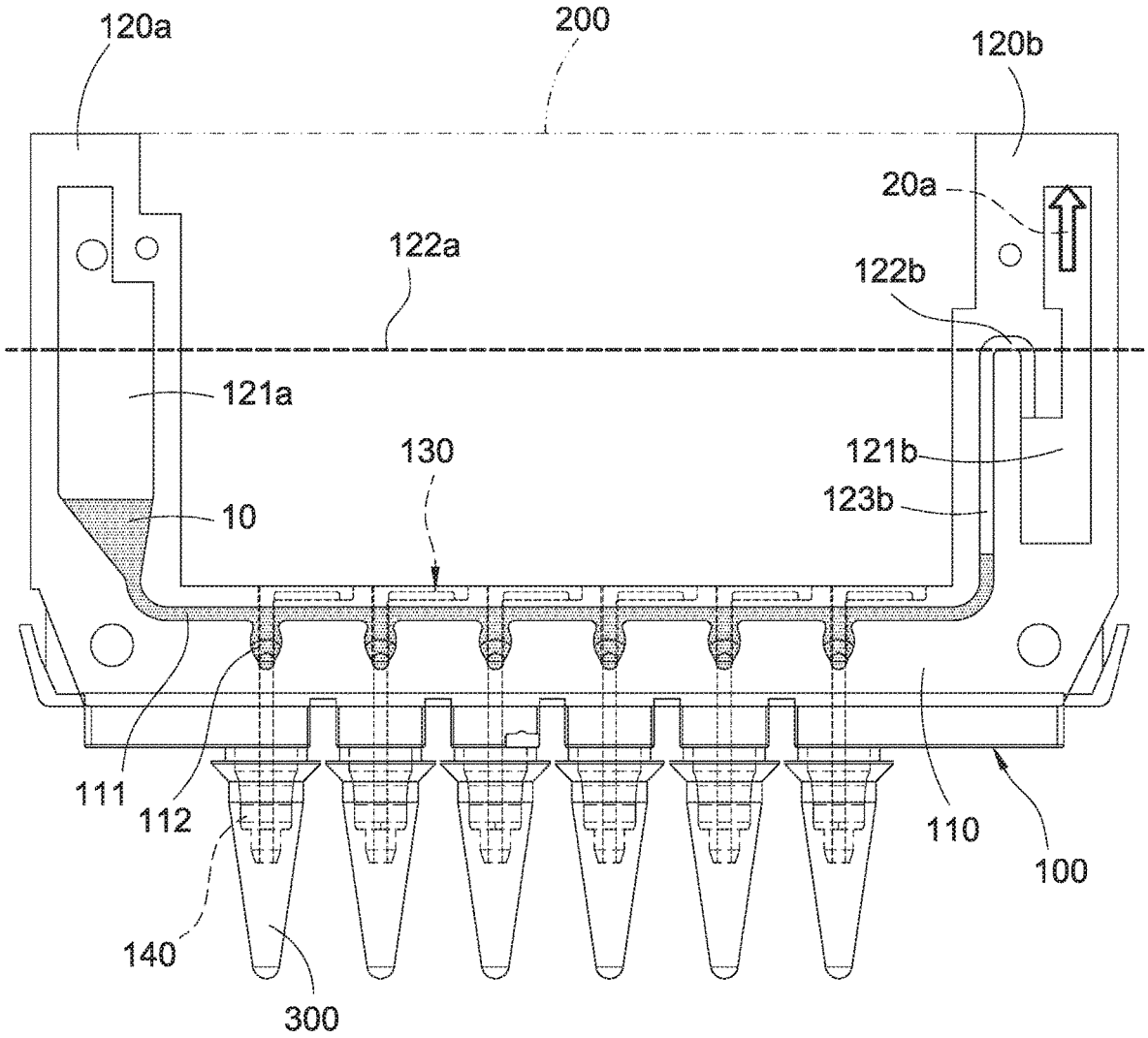
FIG. 10 is a perspective view showing that the liquid sample flows into the respective sampling chambers.

According to FIGS. 9 and 10, the liquid sample 10 in the communicating channel 111 is driven by the gravity thereof caused by the height shift between the sample container 121*a* and the communicating channel 111 to flow into the respective sampling chambers 112, and the liquid samples 10 in the respective sampling chambers 112 are pressed by the flow resistances caused by the respective resistance channels 130, the gravity of the liquid sample 10 could be balanced thereby, and a demanded quantity of liquid sample 10 thereby could be reserved in each sampling chamber 112.

Figure 11:
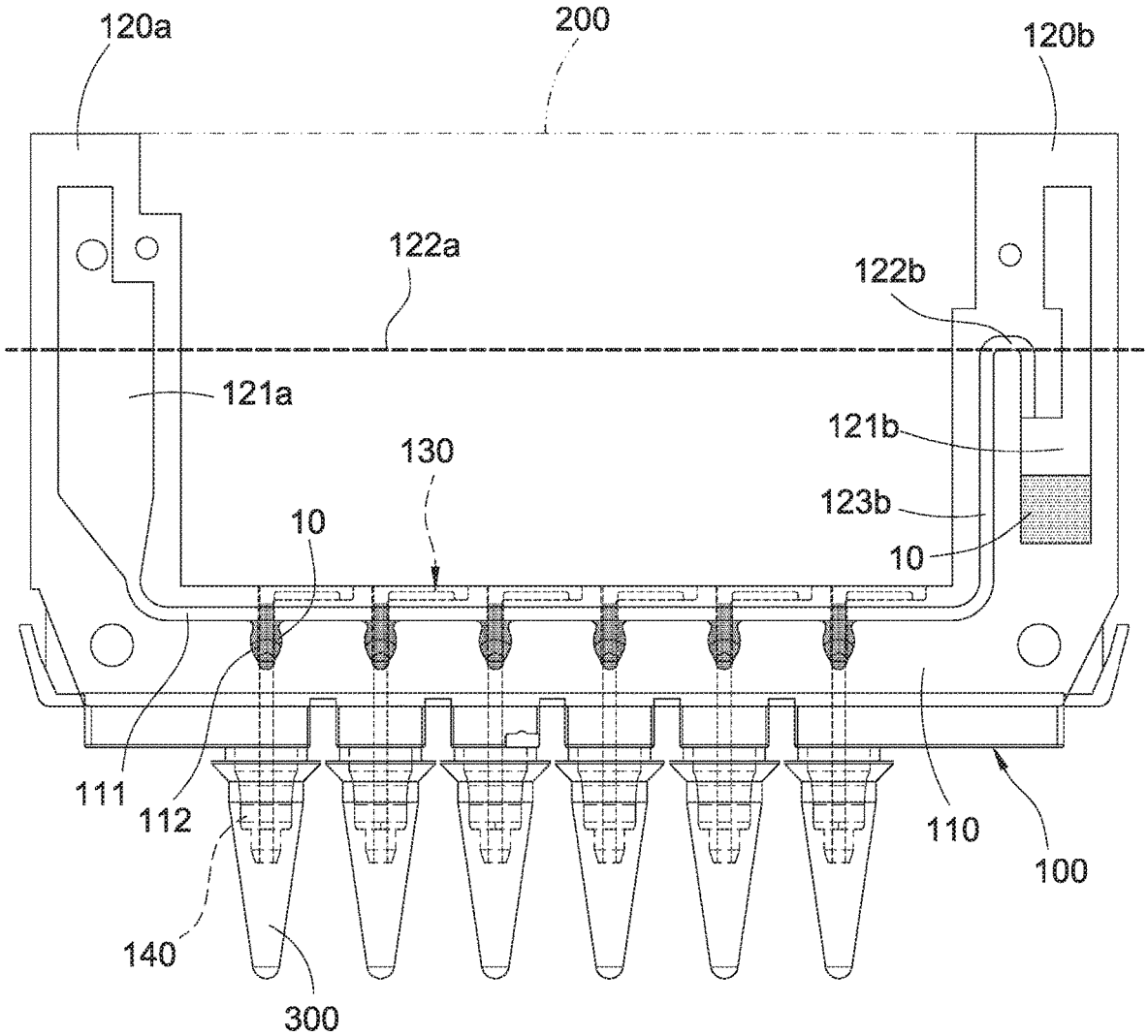
FIG. 11 is a perspective view showing that the liquid sample flows into the recycling chamber.

According to FIGS. 10 and 11, the liquid sample 10 in the communicating channel 111 is driven to flow into the recycling chamber 121*b* by a pressure gradient between the two ends of the communicating channel 111 caused by the negative pressure source 20*a* communicated to the recycling chamber 121*b*.

Figure 12:
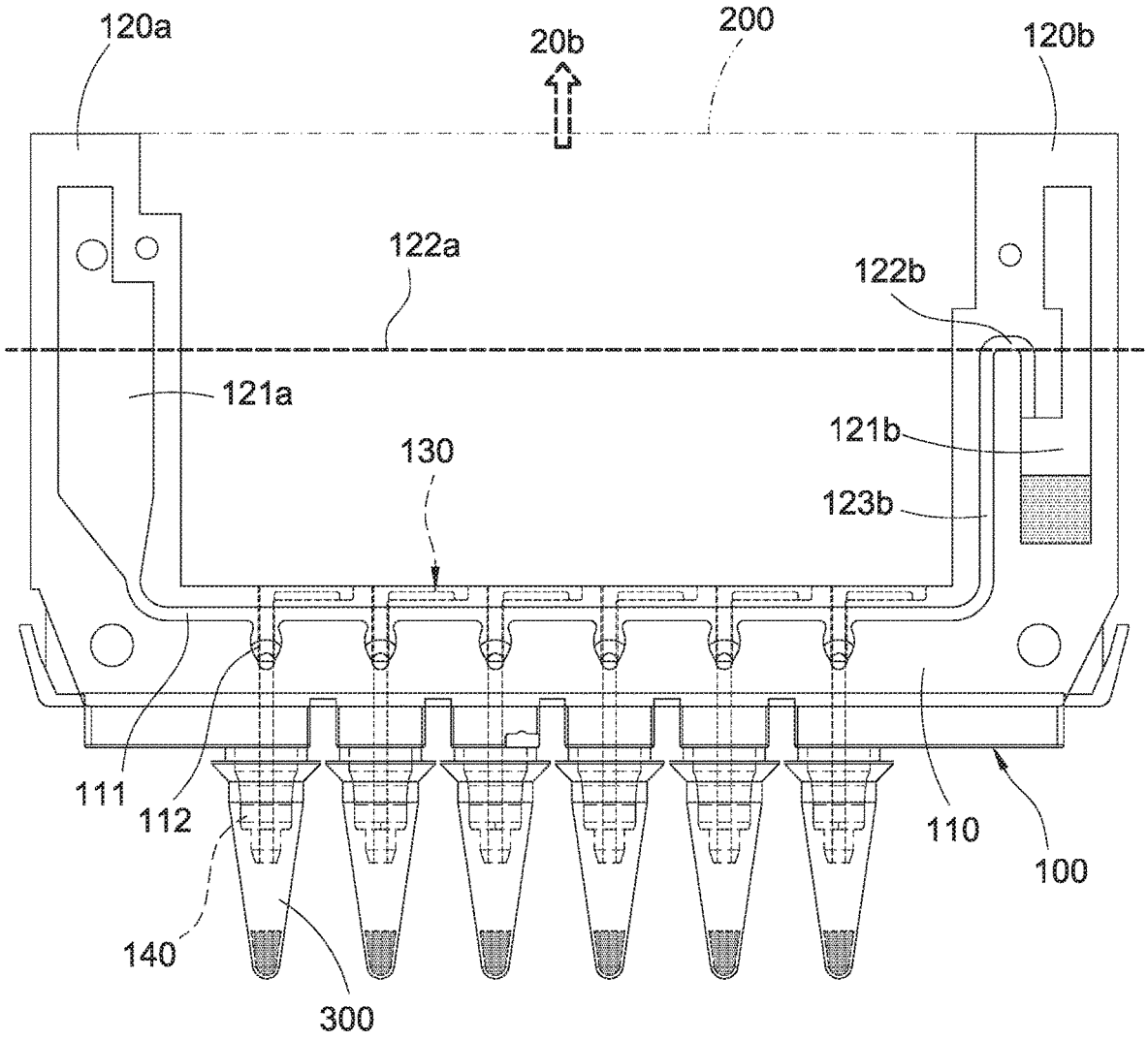
FIG. 12 is a perspective view showing that the liquid samples in the respective sampling chambers flow into the respective tube.

According to FIG. 12, the liquid samples 10 in the respective sampling chambers 112 are driven to flow into the respective tube 300 by the negative pressure source 20*b* communicated with the respective tubes 300 and a sampling process is thereby completed.

Figure 13:
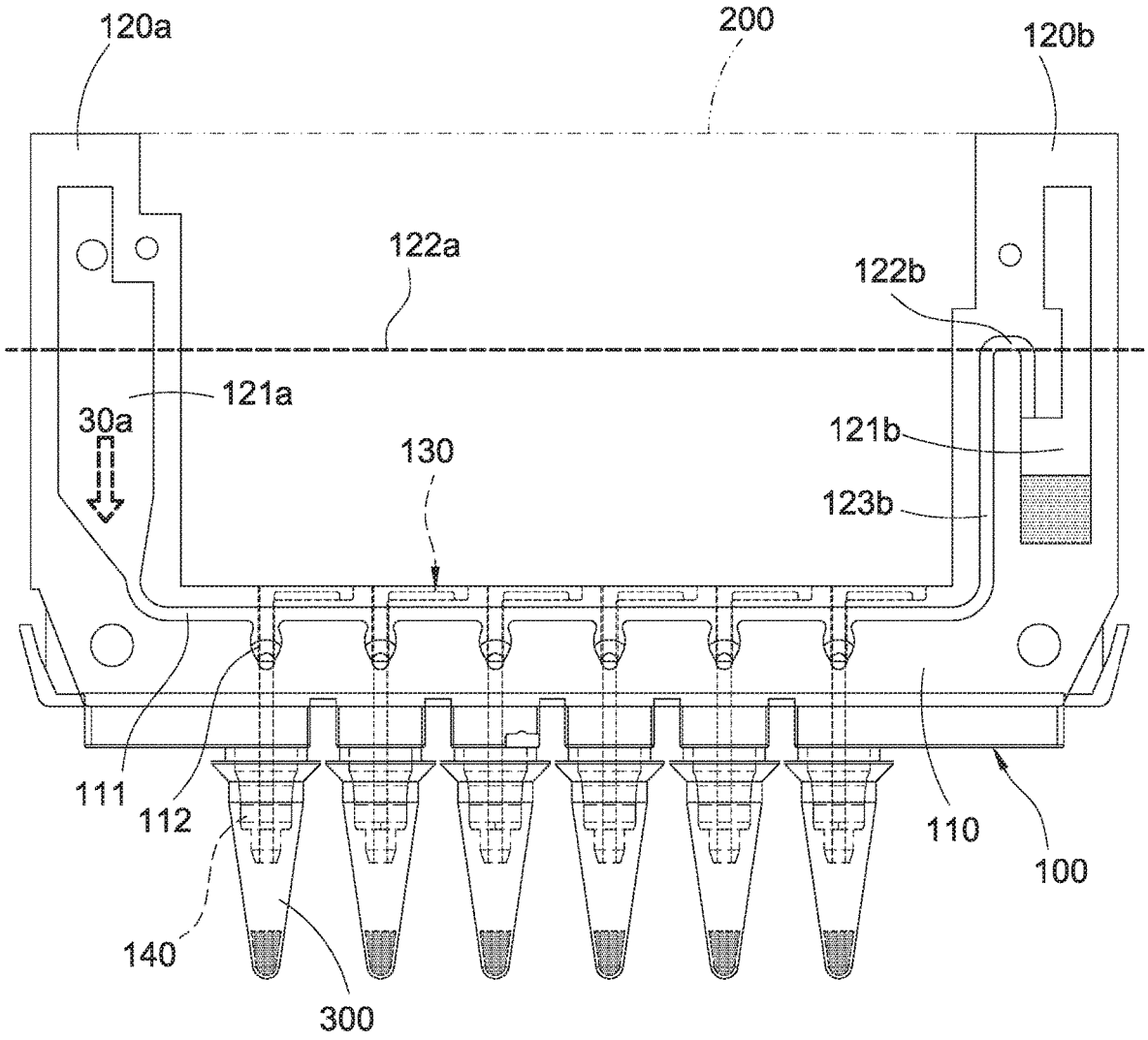
FIG. 13 is a perspective view showing that the communicating channel is communicated to a positive pressure source via the sample container.

According to an alternative arrangement for outputting the liquid sample 10 shown in FIG. 13, the communicating channel 111 is communicated to a positive pressure source 30*a* via the sample container 121*a*, and the respective bypass channels 141 of the respective output joints 140 are communicated to the outside environment. The tubes 300 is preferably communicated to the outside environment via the bypass channels 141 and the docking channels 210 in the docking plate 200. The liquid samples 10 in the respective sampling chambers 112 are driven to flow into the respective tube 300 by the positive pressure source 30*a* and a sampling process is thereby completed.

Figure 14:
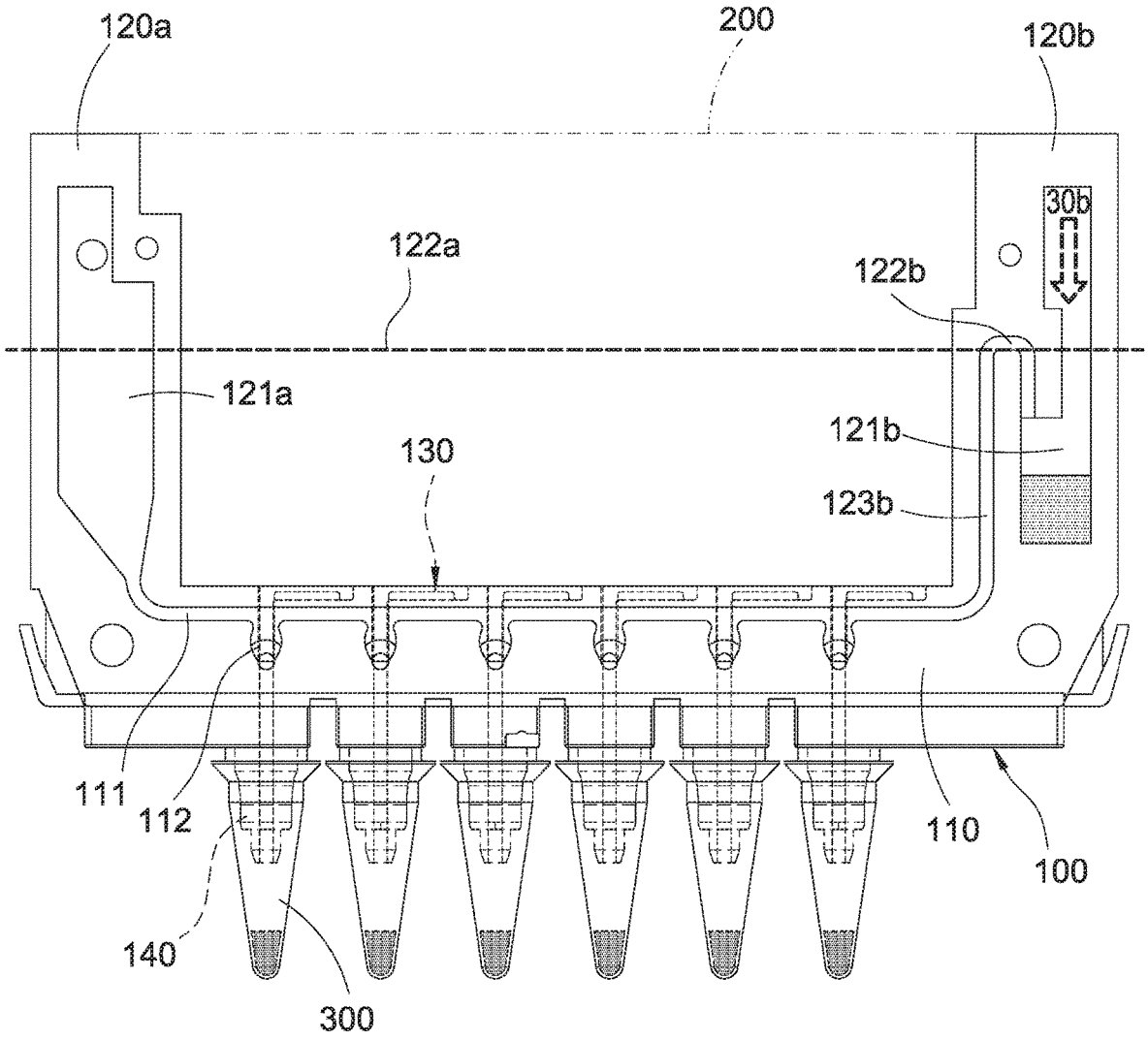
FIG. 14 is a perspective view showing that the communicating channel is communicated to a positive pressure source via the recycling chamber.

According to an alternative arrangement for outputting the liquid sample 10 shown in FIG. 14, the communicating channel 111 is communicated to a positive pressure source 30*b* via the recycling chamber 121*b*, and the respective bypass channels 141 of the respective output joints 140 are communicated to the outside environment. The tubes 300 is preferably communicated to the outside environment via the bypass channels 141 and the docking channels 210 in the docking plate 200. The liquid samples 10 in the respective sampling chambers 112 are driven to flow into the respective tube 300 by the positive pressure source 30*b* and a sampling process is thereby completed.

According to the microscale sampling device of the present invention, the liquid sample 10 in the sample container 121*a* could be driven to flow into the respective sampling chambers 112 by the gravity thereof caused by a height shift between the sample container 121*a* and the sampling chamber 112. Furthermore, the gravity of the liquid sample 10 could be balanced by the resistances caused by the respective resistance channels 130 communicated with the respective sampling chambers 112, and the demanded quantities of the liquid samples 10 thereby could be accurately reserved in the respective sampling chamber 112. Therefore, an additional pressure source for driving the liquid sample 10 in the sample container 121*a* to flow into the sampling chamber 112 is not necessary according to the microscale sampling device of the present invention. According to the microscale sampling device of the present invention, a pressure source is arranged only for recycling the remained liquid sample 10 and outputting the reserved liquid sample 10 rather than sampling, and the pressure source therefore should not be controlled accurately, structures of the microscale sampling device therefore could be simplified.

Although the present invention has been described with reference to the foregoing preferred embodiment, it will be understood that the disclosure is not limited to the details thereof. Various equivalent variations and modifications can still occur to those skilled in this art in view of the teachings of the present invention. Thus, all such variations and equivalent modifications are also embraced within the scope of the present invention as defined in the appended claims.

What is claimed is:

1. A microscale sampling device, comprising a frame, wherein a sample container, a communicating channel, an output joint, a recycling chamber, and a resistance channel are defined in the frame, wherein at least one sampling chamber is defined in the communicating channel; an end of the communicating channel communicates with the sample container and the communicating channel is arranged below the sample container; an end of the resistance channel communicates with the sampling chamber; the other end of the resistance channel communicates to the output joint, and the resistance channel comprises at least one abrupt direction change, depth change, or width change, wherein the other end of the communicating channel communicates with the recycling chamber; wherein the sample container contains a liquid sample below a predetermined level, an inlet communicating with the communicating channel is defined on the recycling chamber, and the inlet is arranged above the predetermined level.

2. The microscale sampling device according to claim 1, wherein the resistance channel is arranged above the communicating channel.

3. The microscale sampling device according to claim 1, wherein the recycling chamber communicates with a negative pressure source or outside environment.

4. The microscale sampling device according to claim 1, wherein the output joint is inside a tube.

5. The microscale sampling device according to claim 4, wherein the tube communicates to a negative pressure source or outside environment.

6. The microscale sampling device according to claim 1, wherein the output joint comprises a bypass channel.

7. The microscale sampling device according to claim 6, wherein the output joint is inside a tube, the tube communicates to outside environment via the bypass channel, and the communicating channel communicates to a positive pressure source.

8. The microscale sampling device according to claim 7, wherein a docking plate is embedded with the frame, a docking channel is defined in the docking plate, and the docking channel communicates with the outside environment and the bypass channel.

9. The microscale sampling device according to claim 8, wherein the docking plate covers and closes the resistance channel.

10. The microscale sampling device according to claim 6, wherein the output joint is inside a tube, and the tube communicates to a negative pressure source via the bypass channel.

11. The microscale sampling device according to claim 10, wherein a docking plate is embedded with the frame, a docking channel is defined in the docking plate, and the docking channel communicates with the negative pressure source and the bypass channel.

12. The microscale sampling device according to claim 11, wherein the docking plate covers and closes the resistance channel.

13. The microscale sampling device according to claim 1, wherein a plurality of sampling chambers arranged along the communicating channel are defined in the communicating channel, and a plurality of resistance channels communicated with the respective sampling chambers are defined on the frame, each resistance channel communicated with the corresponding sampling chamber is not longer than another resistance channel communicated with another sampling chamber closer to the sample container.

* * * * *